United States Patent [19]

Adamik

[11] 4,372,060

[45] Feb. 8, 1983

[54] CONSTRUCTION OF TONGUE FOR SHOE OR THE LIKE ARTICLE

[75] Inventor: Jaroslav F. Adamik, Santa Ana, Calif.

[73] Assignee: MCF Footwear Corporation, New York, N.Y.

[21] Appl. No.: 194,413

[22] Filed: Oct. 6, 1980

[51] Int. Cl.[3] ..... A43B 23/26

[52] U.S. Cl. ..... 36/54; 36/136; D2/265

[58] Field of Search ..... 36/54, 136; 2/DIG. 6; D2/265

[56] References Cited

U.S. PATENT DOCUMENTS

| | | | |
|---|---|---|---|
| 601,192 | 3/1898 | Woodside | 36/54 |
| 3,018,570 | 1/1962 | Bliese | 36/136 |
| 3,537,108 | 11/1970 | Daniels | 2/DIG. 6 |

FOREIGN PATENT DOCUMENTS

| | | | |
|---|---|---|---|
| 870963 | 3/1953 | Fed. Rep. of Germany | 36/54 |
| 1921508 | 10/1970 | Fed. Rep. of Germany | 36/54 |
| 1347424 | 2/1974 | United Kingdom | 36/136 |

*Primary Examiner*—James Kee Chi

*Attorney, Agent, or Firm*—Pennie & Edmonds

[57] ABSTRACT

The structure of the tongue for use with an article of footwear having a receptacle associated therewith, which is defined by a pair of overlaying members. The overlaying members have their side portions joined together with the lower member having an extended portion or flap, at the upper end thereof. The flap member has a closure element which coacts with a corresponding closure element at the upper surface of the upper overlaying member. The flap when bent provides for forming of the closure elements to cause engagement of one another and thereby close the compartment formed in the tongue. Alternatively, the overlaying members, having their side portions joined together, can be joined together at their upper portion to close the compartment without employing the flap member by closure means, such as a zipper.

Various articles such as coins, keys, etc., can be within the compartment to be securely held therein. The upper and lower overlying members are formed interior thereof with foam like material so as to cushion and enable the user to have comfort and stress free use of the footwear with a tongue of this type. In addition, the upper portion of this tongue, that is the portion opposite to the end affixed to the shoe, extends at least several inches beyond the upper lace line of the shoe, thus providing a portion of the compartment for more bulky articles such as rings or chains without the added pressure of the laces on foot of the user.

4 Claims, 5 Drawing Figures

1
2
3
4
5
6
7
9
10
11
12
13
14
15
16
17

CONSTRUCTION OF TONGUE FOR SHOE OR THE LIKE ARTICLE

The present invention is directed to an improved construction for a sport shoe or sneaker employing a tongue portion thereof, which portion includes a compartment and means for closing the compartment.

The concept of the invention relates to a multifunctional construction of a tongue for use in footwear, where such tongue is provided with a compartment suitable for placement of commonly held articles such as coins, I.D. card, a key, etc. and even more bulky articles can be safely and securely positioned in the compartment and retained in place while the user of the footwear is engaged in whatever activities he may be concerned with.

It is commonplace nowadays for athletic shoe users to employ wearing attire which does not contain suitable pockets for the placement of various personal articles, where the articles may be essential for immediate and practical use, as for an example, coins necessary to make a purchase of one kind or another. Obviously, the inability to carefully and securely place such articles and to have immediate access to same while pursuing an athletic endeavor, can be quite important and does indeed give rise to great inconvenience unless some provision is made for such an arrangement to have immediate access.

The prior art associated with such undertakings while generally employing some form of compartment in a tongue, or affixed to a footwear tongue, nevertheless, fails to provide for the use of a specified closure arrangement together with appropriate structure of the tongue as will be set forth hereinbelow; so as to enable the user to employ the footwear with the inventive tongue.

At the same time, it is important to employ the aforementioned compartment without receiving stresses arising from the abrading action of the movement of the shoe during motion and the impact of an upper portion of the foot upon the tongue. As for an example, when a coin or several coins may be in a compartment which can bear upon the user, but for the fact that special provision is made in accordance with the present invention, discomfort can result.

Prior art, such as: U.S. Pat. Nos. 3,631,613; 4,081,916; 601,192; 2,712,700; 3,018,570; 3,284,931 while in some respects illustrate various embodiments which have been considered, the use of structure in the tongue portion of the shoe for purposes of providing a central portion in the tongue suitable for positioning various items that has a designated closure structure and, which has the upper portion of such structure extending at least several inches beyond the upper lace line of the shoe and, which is cushioned to minimize the impact of the contents of the compartment on the foot is not found in the prior art. The invention establishes a most comfortable and secure way for retaining articles varying in bulk and size which need be with the footwear user during the period of use.

The main object of the present invention is to overcome the shortcomings of the prior art.

Another feature of the present invention is to provide for a totally secure tongue portion of a laced footwear suitable for athletic shoes and the like, which enables the user to securely enclose and retain various articles in a compartment formed of the tongue.

Still another object of the present invention is to provide a closure means integrally formed with the tongue so as to enable the user to quickly open and positively secure the closure portion of the compartment in a fashion which is most efficient for use.

The principal features of the present invention are directed to a tongue for footwear, in the form of a receptacle, defined by a pair of overlying members having their side portions joined together, the upper portion of said pair of overlaying members having closure means to detachably secure said members, said upper portion of said overlaying members extending at least several inches above the upper lace line of the footwear, and cushioning means disposed within said overlaying members so as to surround an article placed within the receptacle and cushion the user from the impact of the contents of the compartment.

Other features and advantages of the present invention will be best understood with respect to the accompanying specification, claims and drawings.

IN THE DRAWINGS

DESCRIPTION OF THE INVENTION

Figures 1, 2, 3:
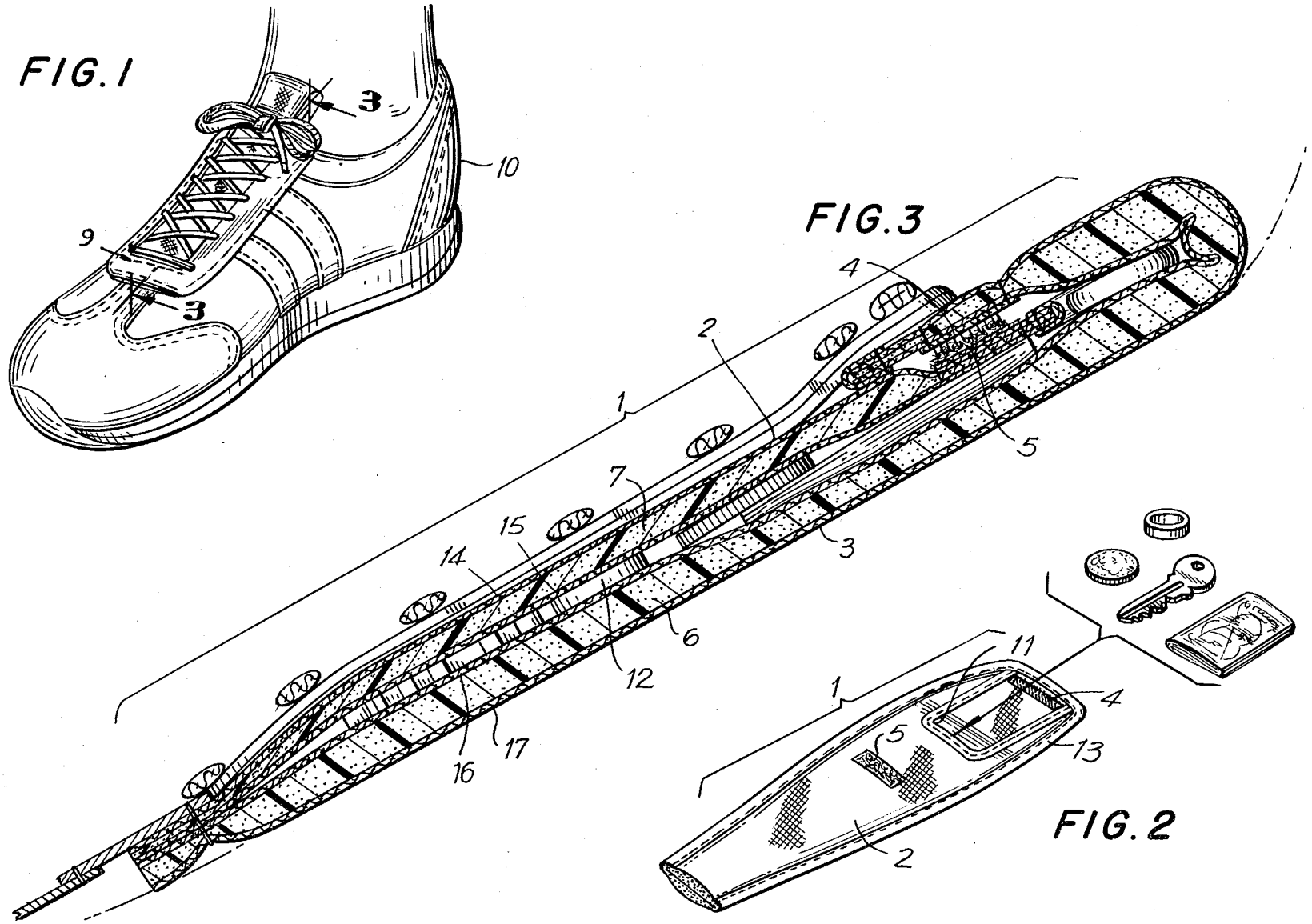
FIG. 1 is a perspective view of footwear such as an athletic shoe having the inventive tongue positioned in a normal use arrangement.
FIG. 2 is a perspective view of a tongue with flap out of the footwear in the open position.
FIG. 3 is a sectional view of FIG. 1 taken along line 3—3.

According to FIG. 3, the tongue 1 of the laced footwear 10 is formed of an upper portion 2 and a lower portion 3. The lower portion 3 has an integral extending portion 13 as shown in FIG. 2 which can be doubled-over, so as to close the open end 11. A suitable closure element 4 is provided at an end of the extending portion 13 of the lower portion 3 which communicates with its associated closure element 5 which is to be disposed at the upper surface of the upper portion 2. The coaction of closure elements 4 and 5 serves to close one end of the compartment 12. The lower end of the tongue 1 is physically affixed to the shoe body as shown in FIG. 1 at 9. The upper end of the tongue, that is, the end opposite to the end affixed at 9, extends at least several inches above the lace line of the shoe as shown in FIG. 1. This upper portion of the compartment 12 may be used to place bulky articles, such as a ring or article of jewelry, without pressure from the laces forcing said article into the foot of the user. Thusly, the compartment 12 is closed and affixed to the footwear as in FIG. 1 by the arrangement shown in FIG. 3, FIG. 4 and FIG. 5.

Figure 4:
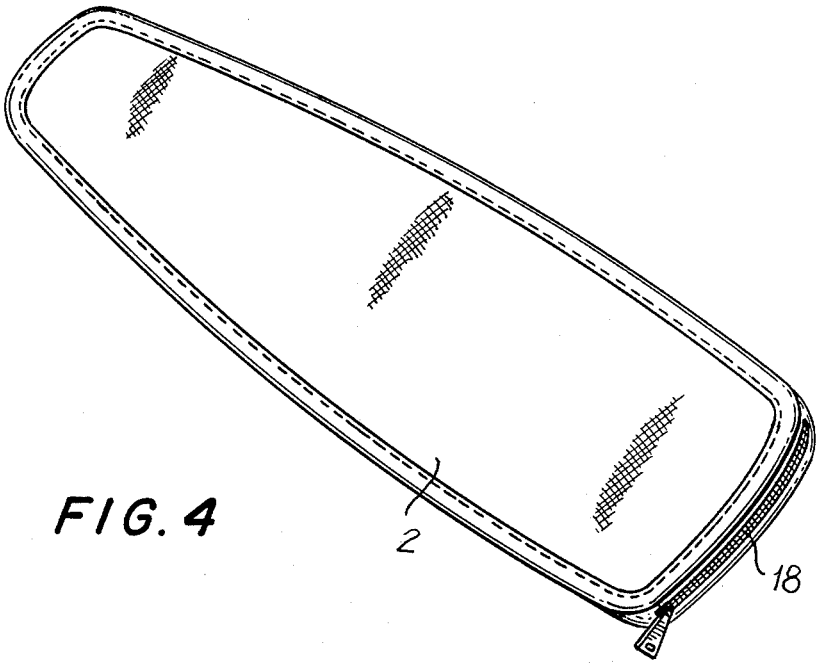
FIG. 4 is a plan view of another embodiment of a tongue with zipper out of the footwear.

FIG. 4 shows an alternate embodiment of the tongue 1 wherein the extending portion 13 and coacting closure elements 4 and 5 shown in FIG. 2 are replaced by a zipper element 18 to detachably secure and close the compartment 12.

Figure 5:
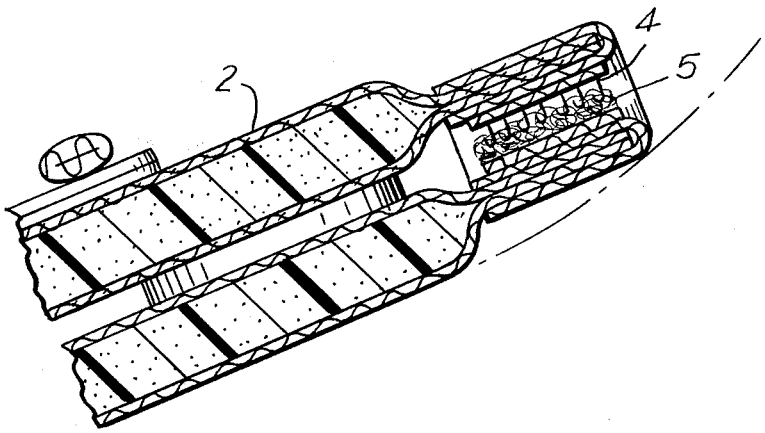
FIG. 5 is a fragmentary sectional view of FIG. 1 in another embodiment taken partially along line 3—3.

According to FIG. 5, the compartment 12 is closed at the upper end 11 by closure elements 4, 5 being affixed to the surfaces 15, 16 of the upper portion 2 and the lower portion 3 at the extreme upper end.

The compartment 12 is suitably shaped so as to be able to retain ordinarily used items such as, coins or keys or I.D. cards, which a footwear user may normally not be able to place in a pocket or other conveniently located secure place due to the particular attire he may be wearing while using the footwear. The importance of this is quite apparent, as when the user may be jogging or perhaps otherwise involved with an activity that might necessitate the need for very light and appropriately flexible clothing so as to allow for the ability to run or perhaps walk in a fashion that is free and easy.

The tongue structure according to the present invention is provided with closure means 4, 5 shown in FIG. 2, FIG. 3 and FIG. 5, and 18 in FIG. 4 which relates the upper and lower overlaying members 2,3 to one another. Closure means 4, 5 is in the form of a VELCRO type (VELCRO is the trademark of American Velcro Inc. for separable tape fasteners) locking mechanism, that enables the user to readily open and close the compartment 12 at an appropriate point so as to cause locking.

The present tongue structure also contemplates the use of a foam-type cushioning material 6, 7 disposed within the respective portions 2, 3 serving to envelope and cushion the articles in the compartment 12, including the upper portion of said compartment 12 set above the lace line, to provide for a comfortable and non-abrasive action when the footwear is in use. The foam-like cushioning material is disposed in the interior surfaces 6, 7 of the outer surfaces 14, 15, 16, 17 of portions 2, 3 and obviously serves to completely surround the articles within the compartment 12 once the closure action has taken place as set forth hereinabove. This is quite important and is significant in that the user is allowed to comfortably dispose his immediate articles while at the same time not being confronted with an inconvenient arrangement when lacing up his shoe as shown in FIG. 1. The tongue 1 manufactured as part of the shoe 10 is stitched in place or otherwise held in place at 9 as shown in FIG. 1 and can be manufactured by stitching or bonding the cushioning material with respect to the outer surfaces of the respective portions 2, 3.

Accordingly, it is the intent of the present invention to provide for a most convenient and stress free compartment 12 for use by a footwear user when especially involved in continuous and long term use as for jogging and running racing.

It is not intended that such inventive arrangement be limited to sporting shoes per se, since the concept obviously can have wide applicability to non-sport type shoes for use in other types of footwear as well.

BEST MODE OF INVENTION

The tongue 1 is in the form of a receptacle 12 defined by a pair of overlaying members 2 and 3 which are joined together. A flap portion formed as an extension of the lower portion 3 of the tongue 1 has affixed thereto an element 4 of the closure which serves to coact within a corresponding engagable closure element 5 at the upper portion 2. The compartment 12 is closed by bending over the extended flap so that the closure elements 4, 5 engage with one another and the compartment is secured. The tongue, affixed into the shoe interior is stitched and positioned fixed at point 9 of the footwear 10. The tongue, at the end opposite the first and affixed at 9, extends at least several inches above the lace line of the shoe with closure elements 4, 5 below and within the lace line of the shoe thereby providing extra security to the compartment and enabling the user to place more bulky items in said upper portion of the compartment 12. The tongue 1 is formed in a generally inverted triangular shape being truncated at the apex.

Although the present invention has been illustrated and described with reference to preferred embodiments thereto, it would be understood that it is by no means limited to the details of such embodiments but is capable of numerous modifications within the scope of the appended claims.

What is claimed:

1. A tongue for use with an article of footwear, in the form of a receptacle, including a first lower member and a second overlaying member, said members having their side portions joined together, the upper portion of said first overlaying member having separable fastener closure means affixed thereto and the upper portion of said lower member having an integrally formed flap member having mating separable fastener closure means affixed thereto so as to facilitate selective separable mating of said fastener closure means to provide selective access to said receptacle, said upper portion of said first and second members extending above the upper lace line of the footwear, and cushioning means formed as part of said first and second members and being disposed beneath an outer surface portion of each of said overlaying members so as to surround an article placed within said receptacle.

2. A tongue as claimed in claim 1, wherein said receptacle is found as generally truncated triangular members joined at two sides.

3. A tongue for use with an article of footwear, in the form of a receptacle, including first and second overlaying members having their side portions joined, a flap member formed integrally with and at an upper portion of a first overlaying member, said flap member having a separable fastener closure element affixed thereto to secure onto a second closure element affixed to said second overlaying member, said upper portion of said overlaying members extending at least several inches above the upper lace line of the footwear, and cushioning means formed as part of said overlaying members being disposed beneath an outer surface of each of said overlaying members to surround an article placed within said receptacle.

4. An article of footwear having a tongue disposed therein and being affixed thereto at a first end, wherein said tongue comprises a receptacle including a first lower member and a second overlaying member, said members having their side portions joined together, the upper portion of said first overlaying member having separable fastener closure means affixed thereto and the upper portion of said lower member having an integrally formed flap member having mating separable fastener closure means affixed thereto so as to facilitate selective spearable mating of said fastener closure means to provide selective access to said receptacle, said upper portion of said first and second members extending above the upper lace line of the footwear, and cushioning means formed as part of said first and second members and being disposed beneath an outer surface portion of each of said overlaying members so as to surround an article placed within said receptacle.

* * * * *

UNITED STATES PATENT AND TRADEMARK OFFICE

CERTIFICATE OF CORRECTION

PATENT NO. : 4,372,060

DATED : February 8, 1983

INVENTOR(S) : Jaroslav F. Adamik

It is certified that error appears in the above-identified patent and that said Letters Patent is hereby corrected as shown below:

Column 2, line 8, "overlying" should read -- overlaying --.

Column 4, line 57, "spearable" should read -- separable --.

Signed and Sealed this

Nineteenth Day of April 1983

[SEAL]

*Attest:*

GERALD J. MOSSINGHOFF

*Attesting Officer*

*Commissioner of Patents and Trademarks*